US006160464A

United States Patent [19]

Clarke et al.

[11] Patent Number: 6,160,464

[45] Date of Patent: Dec. 12, 2000

[54] SOLID CAST RESIN COIL FOR HIGH VOLTAGE TRANSFORMER, HIGH VOLTAGE TRANSFORMER USING SAME, AND METHOD OF PRODUCING SAME

[75] Inventors: Peter William Clarke, Milton; George Scott Hood, South Hero; Alan Scott Gould, Moretown, all of Vt.

[73] Assignee: Dynapower Corporation, South Burlington, Vt.

[21] Appl. No.: 09/190,780

[22] Filed: Nov. 12, 1998

Related U.S. Application Data

[60] Provisional application No. 60/073,975, Feb. 6, 1998.

[51] Int. Cl.[7] ..... H01F 27/08; H01F 27/30

[52] U.S. Cl. ..... 336/60; 336/61; 336/96; 336/205; 336/206; 336/225

[58] Field of Search ..... 336/96, 60, 55, 336/225, 192, 205, 61

[56] References Cited

U.S. PATENT DOCUMENTS

| | | | |
|---|---|---|---|
| 1,452,158 | 4/1923 | Horelick | 336/60 |
| 2,710,947 | 6/1955 | Gaston | 336/60 |
| 3,170,134 | 2/1965 | Palmer | 336/60 |
| 3,195,084 | 7/1965 | Book | 336/60 |
| 3,748,616 | 7/1973 | Weber et al. | 336/60 |
| 4,173,747 | 11/1979 | Grimes et al. | 336/60 |
| 4,337,569 | 7/1982 | Pierce | 336/60 |
| 4,523,169 | 6/1985 | Hay | 336/60 |
| 5,267,393 | 12/1993 | Purohit et al. | 336/192 |
| 5,396,210 | 3/1995 | Purohit et al. | 336/205 |
| 5,621,372 | 4/1997 | Purohit | 336/205 |

*Primary Examiner*—Thomas J. Kozma
*Attorney, Agent, or Firm*—Burr & Brown

[57] ABSTRACT

A dry-type transformer having an iron core, with high voltage and low voltage coils encapsulated in casting resin. The high and low voltage windings may be cast separately, or together. Either or both of the coils may have integral axial cooling channels, as may the annular axial space between the inner and outer windings (usually low voltage and high voltage, respectively). Coil cross-section is a modified oval (Rectoval™) shape, in that the sides of the coil are substantially linear and the ends of the coils are substantially semi-circular. The aspect ratio (L/W) of the coil, when viewed in radial cross-section, ranges from greater than 1.0 to about 2.5. The rectangular nature of the coil allows for the use of a core member having a rectangular cross-section, thereby reducing the manufacturing expense involved with shaping the core member. The circular nature of the ends of the coil provide improved strength similar to that of circular/cylindrical coils. This specific coil cross-sectional shape gains the benefits of reduced "footprint" (in the width dimension), shorter magnetic path-length (reduced core losses), and reduced material content (cost) in the transformer. This specific coil shape also allows for the use of molds constructed using standard modularized rounded pieces for the ends of the coil, together with simple flat side spacer plates, to cover any given kVA size range. Encapsulating material, such as epoxy resin having macro fibers of Wollastonite for reinforcement dispersed therethrough, is disposed about and throughout each winding, to thereby form an integral, monolithic coil structure. The windings are additionally reinforced in both the axial and circumferential directions, by the incorporation of a woven fiberglass mesh proximate to all vertical coil surfaces exposed to either natural convection, or forced blowing. As a result of this dual reinforcement, the coils exhibit high short circuit withstandability, in spite of their departure from the more common circular/cylindrical shape heretofore known in the prior art.

9 Claims, 3 Drawing Sheets

SOLID CAST RESIN COIL FOR HIGH VOLTAGE TRANSFORMER, HIGH VOLTAGE TRANSFORMER USING SAME, AND METHOD OF PRODUCING SAME

CROSS REFERENCE TO RELATED APPLICATION

Reference is made to and priority claimed from U.S. Provisional Application Ser. No. 60/073,975, filed Feb. 6, 1998, entitled "Solid Cast Resin Coil for High Voltage Transformer, High Voltage Transformer Using Same, and Method of Producing Same".

BACKGROUND OF THE INVENTION

1. Technical Field

The invention relates generally to dry type transformers having an iron core, a high voltage coil including a winding embedded in cast resin, and a low voltage coil including a winding embedded in cast resin, and also relates to a method of manufacturing the coils. The general structure of the transformer is similar to that described in Purohit et al U.S. Pat. No. 5,267,393, which is incorporated herein by reference.

2. Background Art

Dry type transformers with primary voltages over 600 volts have generally been constructed using one of three known techniques: conventional dry, resin encapsulated, or solid cast. The conventional dry method uses some form of vacuum impregnation with a solvent type varnish on a completed assembly consisting of the core and the coils of individual primary and secondary coils. Some simpler methods require just dipping the core and the coils in varnish without the benefit of a vacuum. This process inevitably results in voids or bubbles in the solidified varnish due to the presence of moisture and air, and thus does not lend itself to transformer applications above 600 volts. The resin encapsulated method encapsulates a winding with a resin with or without a vacuum, but does not use a mold to contain the resin during the curing process. This method does not insure complete impregnation of the windings with the resin and therefore the turn to turn insulation and layer insulation must provide the isolation for the voltage rating without consideration of the dielectric rating of the resin. The solid cast method utilizes a mold around the coil which is the principal difference between it and the resin encapsulated method. The windings are placed in the mold and impregnated and/or encapsulated with a resin under a vacuum, which is then allowed to cure before the mold is removed. Since all of the resin or other process material is retained during the curing process, there is a greater likelihood that the windings will be free of voids, unlike the resin encapsulated method whereby air can reenter the windings as the resin drains away before and during curing. Cooling channels can be formed as part of the mold.

Since the resin used in solid cast coils results in more of a solid bond between adjacent conductors than is possible with resin encapsulated coils, solid cast coils exhibit better short circuit strength among the windings. Part of this is because the conductors in the coils are braced throughout by virtue of the solid casting resin, and thus there is less likelihood of movement of the coils during short circuit conditions and short circuit forces are generally contained internally. An added benefit is that by having greater mass, there is a longer thermal time constant with the solid cast type coils and there is better protection against short term overloads.

In the field of high voltage transformers, the coils have been manufactured in the shape of cylinders to provide maximum short circuit strength. Specifically, under short circuit conditions, the outer windings of the coil have a natural tendency to expand in the form of a circle, and the inner windings of the coil have a natural tendency to constrict in the form of a circle. By forming the coil as a cylinder, the windings are already in the desired configuration that provides maximum short circuit strength. Moreover, from a mechanical strength standpoint, a cylindrical body will provide the highest strength as any induced loads will be distributed evenly around the entire circumference of the body.

A problem with the use of cylindrical coils, however, is that the transformer core must be manufactured so that the core fills as much of the inner space of the coil as possible (i.e., achieves a high core area/hole area ratio). Such cores typically are referred to as having a cruciform construction. This complex construction increases the overall expense of forming the transformer, and presupposes that the core material consists of fiat stacked laminations. Some newer core materials cannot practically be made into flat stacked laminations. Thus, the newer cores commonly consist of thin wound strips, most commonly of a single constant width, thus forming an essentially rectangular core cross-sectional shape.

DETAILED DESCRIPTION OF THE INVENTION

Figure 1:
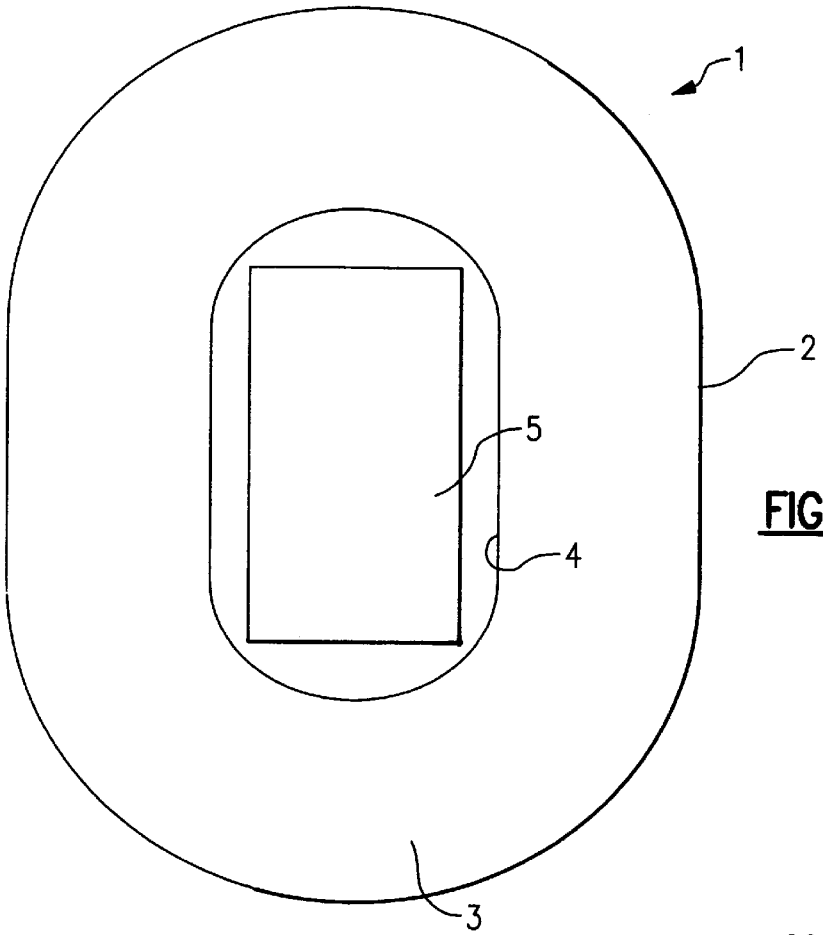
FIG. 1 is a diagram illustrating the cross-sectional shape of the coil according to the present invention.

The present invention was developed to provide a transformer that could make use of solid resin casting techniques and also use new core materials that are difficult to manufacture. The result was a transformer that adopts the general structure of known high voltage transformers, but makes use of novel cast resin coils having a shape that departs radically from traditional coil designs for high voltage transformers. Specifically, the coil in accordance with the present invention has a modified oval cross-section such as shown diagrammatically in FIG. 1. The coil 1 has substantially flat sidewalls 2 and substantially semi-circular end walls 3, which cooperate to define an inner bore 4 for receiving a transformer core 5. The shape of the inner bore allows for the use of core members having rectangular cross-sections. The substantially semi-circular end walls 3 retain the strength attributes of circular cross-sectioned coils, and the flat sidewalls 2 complement the shape of the rectangular cross-sectioned non-machined core members to increase the core area/bore area ratio.

Depending upon the voltage and kVA rating and thus the overall size of the coil, the aspect ratio (length/width) of the coil preferably is greater than 1 up to about 2.5. This specific shape, in combination with other features of the invention described below, allow the coil to have sufficient short circuit strength to be used in high voltage transformers.

Figure 2:
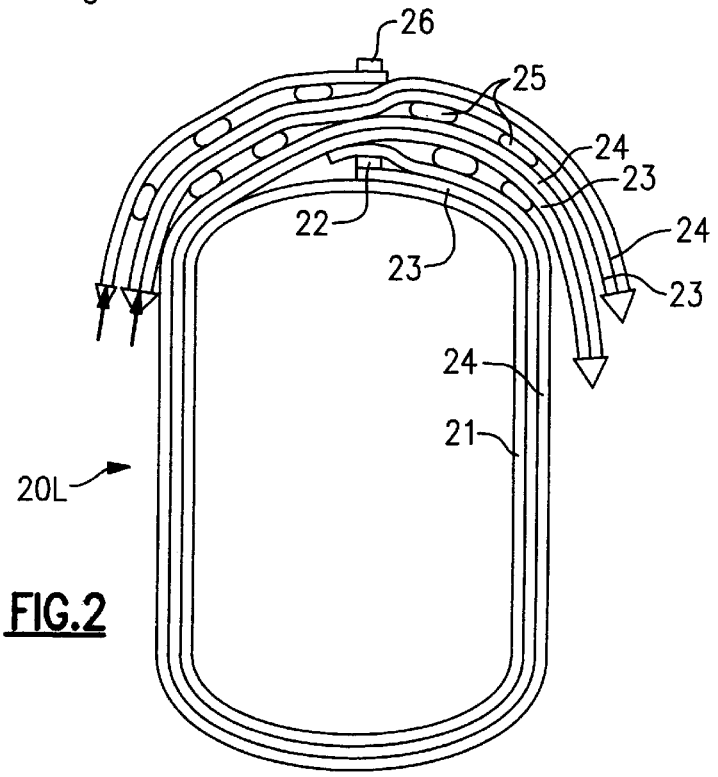
FIG. 2 is a diagram illustrating the winding process used to form the low voltage coil according to the present invention.

In one embodiment of the invention as shown in FIG. 2, the inner or low voltage coil 43 (usually, but not always known as the secondary coil) is formed on a special mandrel or mold inner shell 21 on which one external lead 22, which is welded to a foil conductor sheet 23 such as copper or aluminum, will rest during the start of the winding. A layer of insulating material 24, such as DuPont's Nomex®, is interposed between successive layers of foil during the winding process. The insulating material is impregnated and coated with thermoset or B-stage adhesive that, when cured through heating, prevents movement of adjacent windings during subsequent casting of the low voltage coil in resin. One example of such an adhesive is the bisphenyl-A epoxy resin supplied by ELECTROLOCK INC., under the name BAP75. This feature of the invention allows the various windings to retain their modified oval shape prior to casting. And, the resin, once cast and solidified around the windings, will provide a better bond between the windings because the various windings are held in place throughout processing. The adhesive bonding between windings will also provide extra strength to the windings in the finished coil and thus help prevent their movement under short circuit conditions. The adhesive bonding and improved bonding of the cast resin to the various windings of the coil cooperate to retain the overall modified oval shape of the cast coil.

As shown in FIG. 2, spacers 25 are added at predetermined intervals throughout the coil during the winding process to form air cooling channels in the final cast coil. To accommodate the thickness of the external leads without causing a bulge in the outer surface of the overall coil, a sufficient number of the cooling channel spacers 25 are omitted where the starting external lead 22 has been located, to permit the winding conductor and layer insulation material to be collapsed towards the starting external lead 22. The finish end of the winding terminates with a finishing external lead 26 welded to the conductor material, and positioned directly over the starting external lead 22. As can be seen from FIG. 2, the absence of cooling channel spacers 25 in the region of the starting and finishing external leads allows those components to be situated flush with the overall outer surface of the coil.

After the coil is thus assembled, it is subjected to the cast resin process, which entails the coil being enclosed in a metal mold and sealed to prevent leakage of the casting resin during the casting process. The coil/mold assembly is preheated in an oven to remove moisture from the insulation and the copper or aluminum windings. This pre-heating step can also serve to cure the adhesive impregnated in the insulating layers interposed between the turns of metal foil. The coil/mold assembly is then placed in a vacuum casting chamber which is evacuated to remove any remaining moisture and gases. Through this process, voids between adjacent windings are essentially eliminated. A liquid resin is then introduced into the coil/mold assembly, still under a vacuum, until the coil is completely submerged. After a short time interval which will allow the resin to impregnate the insulation layers 24 and fill all spaces between adjacent coil windings, the vacuum is released and the coil/mold assembly is then removed from the chamber. The coil is then placed in an oven to cure the resin to a solid. After the resin is filly cured, the coil/mold assembly is removed from the oven, the mold assembly is removed from the coil, and the cooling channel spacers are removed from the coil. The result is a monolithic body of epoxy resin having evenly spaced windings and cooling channels formed therein.

The completed coil has superior basic impulse level (BIL) protection since there are essentially no voids in the solid cast resin. Short circuit withstandability is improved since there is little chance of the individual windings moving due to the bonding among the impregnated insulating material layers and the cast resin. The overload capacity of the coil also is increased since heat generated in the windings will transfer to the cooling ducts more efficiently through a solid mass than if voids were present in the windings.

The outer or high voltage coil 44 (usually, but not always known as the primary coil) is a cast resin coil and is fabricated using a similar process as the one described above, except that the coil windings are built up as discs, as opposed to foil layers. The conductor material for the high voltage coil windings can be copper or aluminum, both wrapped in ½ or ⅓ lap Nomex® tape, and each disc is formed by winding the wrapped conductor material on itself until a desired thickness has been achieved. Thereafter, the conductor material is shifted axially and winding of the next disc begins. This process continues until the desired number of discs have been formed. After the high voltage coil windings are completed, the windings are placed in a mold to receive resin in the same manner described above, and then curing of the resin takes place inside the mold.

The high voltage coil can be formed as a separate unit or integrally with the low voltage coil. In the latter case, appropriate insulating material would be disposed on the outer surface of the low voltage coil and then the high voltage coil windings would be formed on the insulating material. In the case of high kVA transformers, it is preferred to form the coils separately, such that, during assembly of the transformer, a relatively large radial air gap can be formed between the outer surface of the low voltage coil and the inner surface of the high voltage coil.

The transformer is assembled by inserting the inner coil over an iron laminated core and then inserting the outer coil around the inner coil. The resultant assembly is then secured with appropriate clamps and mounting feet, along with terminal means for external connections.

The resin used to encapsulate the coil windings can be any type of resin that can achieve all of the criteria described above. One example is a bisphenyl-A resin supplied by Ciba-Geigy under the trade name ARALDITE. The resin preferably includes macro fibers of Wollastonite dispersed throughout to provide reinforcement in the cast resin matrix. Wollastonite fibers have a much higher thermal conductivity than casting resins, and thus serve to enhance the flow of heat from the winding conductor material to the coil outside surface. The windings may also be reinforced in both the axial and circumferential directions, by the incorporation of a woven fiberglass mesh proximate to all vertical coil surfaces exposed to either natural convection, or forced blowing. The use of fiber and mesh reinforcements contribute to the ability of the modified oval coils to achieve sufficient short circuit strength to allow their use in high voltage transformer applications.

Figure 3:
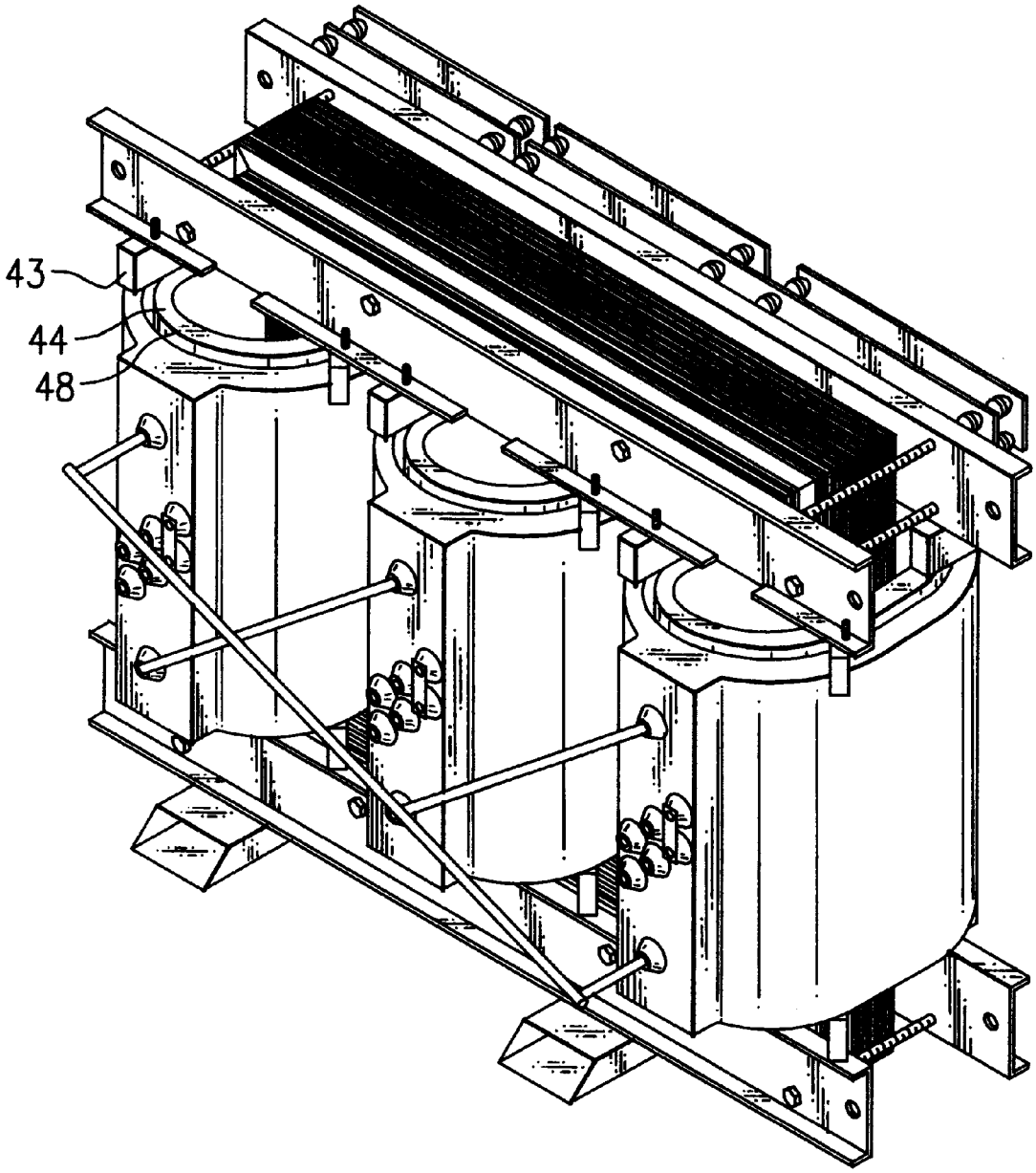
FIG. 3 is a perspective view showing a three phase dry-type high voltage transformer constructed according to the present invention.

FIG. 3 shows a three-phase transformer similar in general construction to the transformer described in Purohit et al U.S. Pat. No. 5,267,393, with the exception being the cross-sectional shape and construction of the coils. In FIG. 3, a low voltage coil 43 is positioned around each leg of the transformer core 45, and a high voltage coil 44 is disposed around each low voltage coil 43. The transformer depicted in FIG. 3 is a relatively high voltage transformer, and thus a radial air gap 48 is formed between the low and high voltage coils. For lower voltage applications, the low and high voltage coils could be cast as a single monolithic body.

Figure 4:
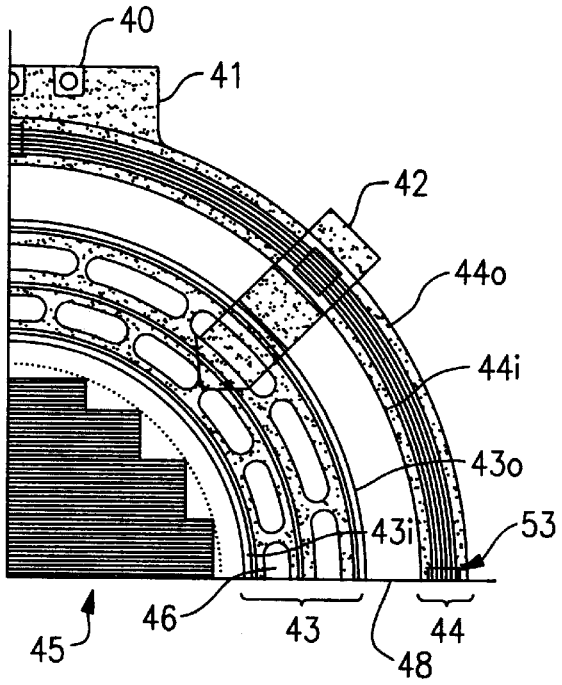
FIG. 4 is a partial top plan view showing one-quarter of the rounded end walls of the low and high voltage coils.

FIG. 4 is a partial top plan view of the low and high voltage coils in accordance with the present invention. This view shows one-quarter of the curved end wall sections of the coils. The low voltage coil 43 is disposed around one leg of the transformer core 45, and includes air channels 46 formed by spacers 25 during the casting process. The low voltage coil has an inner diameter 43*i* and an outer diameter 43*o*. The high voltage coil 44 is disposed outside the low voltage coil 43 and includes a tap boss 41 and threaded tap inserts 40 formed during the molding process. The high voltage coil has an inner diameter 44*i* and an outer diameter 44*o*. A core spacer block 42 is used to maintain a radial air gap 48 between the low and high voltage coils. The stippling shown in FIG. 4, other than that shown on spacer block 42, shows the position of the solidified cast resin in the final coil structure.

Figure 5:
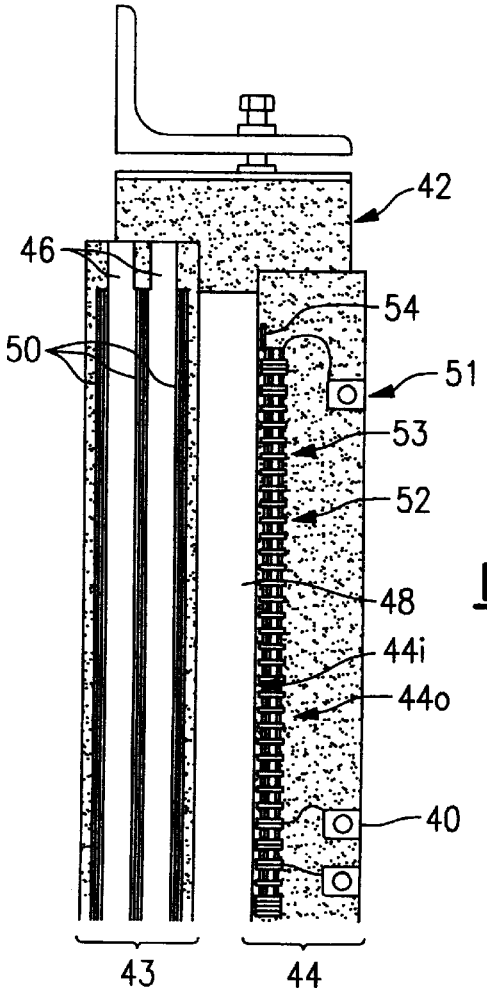
FIG. 5 is a partial axial cross-sectional view showing the positional relationship of the low and high voltage coils in the transformer construction of FIG. 3.

FIG. 5 is a partial axial cross-sectional view showing more of the internal structure of the low and high voltage coils. FIG. 5 shows that the low voltage coil 43 includes three regions of foil conductor 50, and each region includes multiple layers of metal foil separated by insulating layers, as explained above. The high voltage coil includes a plurality of conductor discs 52, formed in the manner explained above. A plurality of insulating key spacers 53 separate the conductor discs from one another in the axial direction. The key spacers are carried by an insulating key stick 54. All the insulating components can be formed of Nomex®. The high voltage connection 51 for the high voltage coil is formed during the casting process. The stippling shown in FIG. 5, other than that shown on spacer block 42, shows the position of the solidified cast resin in the final coil structure.

What is claimed is:

1. A monolithic, solid cast resin coil for a transformer having a primary voltage rating of at least 600 volts, comprising:

a solid cast resin body formed in the shape of a hollow tube having substantially linear side walls connected together by substantially curved end walls, such that the body has a radial cross-sectional shape in the form of a modified oval having an aspect ratio of greater than 1 up to about 2.5;

reinforcement fibers dispersed throughout said solid cast resin body, said reinforcement fibers having a thermal conductivity greater than that of said solid cast resin body;

woven reinforcement mesh layers positioned in said solid cast resin body proximate inner and outer circumferential surfaces thereof, for providing reinforcement in the axial and circumferential directions of said solid cast resin body; and conductor windings embedded in the interior of the solid cast resin body.

2. The monolithic, solid cast resin coil of claim 1, wherein said conductor windings include multiple turns of a conductor sheet material with an insulating sheet material interposed between said multiple turns, and said insulating sheet material includes bonding means for preventing movement of said conductor sheet material during short circuit conditions.

3. The monolithic, solid cast resin coil of claim 1, further comprising cooling channels interposed between adjacent turns of said conductor windings.

4. A dry-type transformer having at least one phase, comprising;

a transformer core having a leg for each of said at least one phase;

a low voltage coil disposed around said leg and functioning as a secondary winding for each of said at least one phase, said low voltage coil comprising a solid cast resin body formed in the shape of a hollow tube having substantially linear side walls connected together by substantially curved end walls, such that the body has a radial cross-sectional shape in the form of a modified oval having an aspect ratio of greater than 1 up to about 2.5, said solid cast resin body including (i) reinforcement fibers dispersed throughout, said reinforcement fibers having a thermal conductivity greater than that of said solid cast resin body, (ii) woven reinforcement mesh layers positioned proximate inner and outer circumferential surfaces of said solid cast resin body, for providing reinforcement in the axial and circumferential directions of said solid cast resin body, and (iii) multiple turns of a conductor sheet material with an insulating sheet material interposed between said multiple turns; and a high voltage coil disposed around said low voltage coil and functioning as a primary winding for each of said at least one phase, said high voltage coil comprising a solid cast resin body formed in the shape of a hollow tube having substantially linear side walls connected together by substantially curved end walls, such that the body has a radial cross-sectional shape in the form of a modified oval having an aspect ratio of greater than 1 up to about 2.5, said solid cast resin body including (i) reinforcement fibers dispersed throughout, said reinforcement fibers having a thermal conductivity greater than that of said solid cast resin body, (ii) woven reinforcement mesh layers positioned proximate inner and outer circumferential surfaces of said solid cast resin body, for providing reinforcement in the axial and circumferential directions of said solid cast resin body, and (iii) conductor windings embedded in the interior of said solid cast resin body.

5. The dry-type transformer of claim 4, wherein said insulating sheet material includes bonding means for preventing movement of said conductor sheet material during short circuit conditions.

6. The dry-type transformer of claim 4, further comprising cooling channels interposed between adjacent turns of said conductor sheet material.

7. The dry-type transformer of claim 4, wherein said high voltage coil further comprises termination means for connection to a high voltage AC source.

8. The dry-type transformer of claim 4, wherein said low voltage coil further comprises termination means for outputting a lower AC voltage.

9. The dry-type transformer of claim 4, wherein said core is formed in a cruciform shape from laminated straps of iron.

* * * * *